United States Patent [19]

Jupin et al.

[11] Patent Number: 4,807,784

[45] Date of Patent: Feb. 28, 1989

[54] DISPENSER FOR PASTY PRODUCT

[75] Inventors: Alain Jupin; Bernard Schneider, both of Sainte Menehould, France

[73] Assignee: Cebal, Clichy, France

[21] Appl. No.: 102,552

[22] Filed: Sep. 29, 1987

[30] Foreign Application Priority Data

Oct. 13, 1986 [FR] France ..... 86 14348

[51] Int. Cl.[4] ..... B65D 37/00

[52] U.S. Cl. ..... 222/207; 222/383

[58] Field of Search ..... 222/207, 209, 212, 215, 222/383, 385, 387, 517, 494; 137/854, 859, 512.4

[56] References Cited

U.S. PATENT DOCUMENTS

| | | | |
|---|---|---|---|
| 4,394,939 | 7/1983 | Thor et al. | 222/207 |
| 4,564,130 | 1/1986 | Eulenburg | 222/207 |
| 4,565,306 | 1/1986 | Nakanishi et al. | 222/383 |

FOREIGN PATENT DOCUMENTS

| | | |
|---|---|---|
| 0048421 | 9/1981 | European Pat. Off. . |
| 0179342 | 5/1985 | European Pat. Off. . |
| 8518670 | 6/1985 | Fed. Rep. of Germany . |

*Primary Examiner*—F. J. Bartuska
*Assistant Examiner*—Kenneth Noland
*Attorney, Agent, or Firm*—Dennison, Meserole, Pollack & Scheiner

[57] ABSTRACT

In a dispenser, a tubular body carrying on its top a suction valve for suction of a pasty produce into a compression chamber, a distribution head between the chamber and a distribution pipe, a central orifice in the top surrounded by a bearing surface forming the seat of the suction valve, an actuator including the distribution pipe and a duct fitting the top of a deformable cap which defines the compression chamber; the deformable cap including a deformable web and an upper tube carrying a flexible lip forming a valve with the bottom of the duct for expelling the product into pipe.

16 Claims, 4 Drawing Sheets

FIG.6
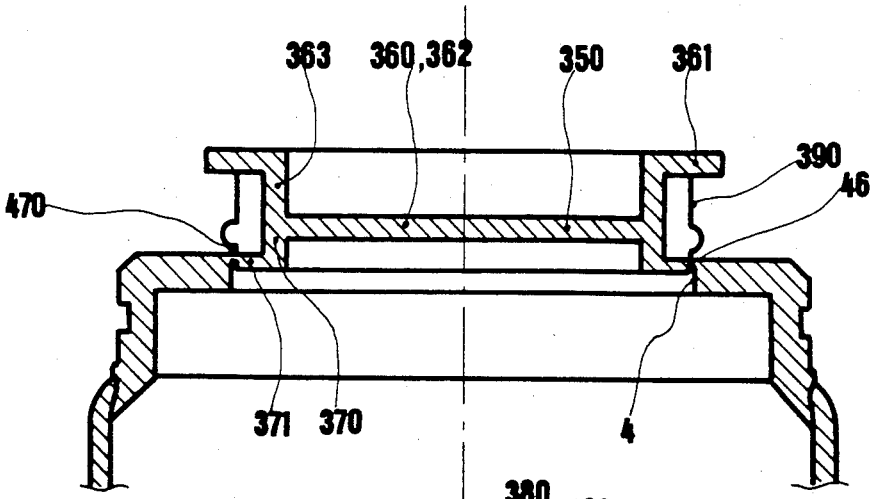
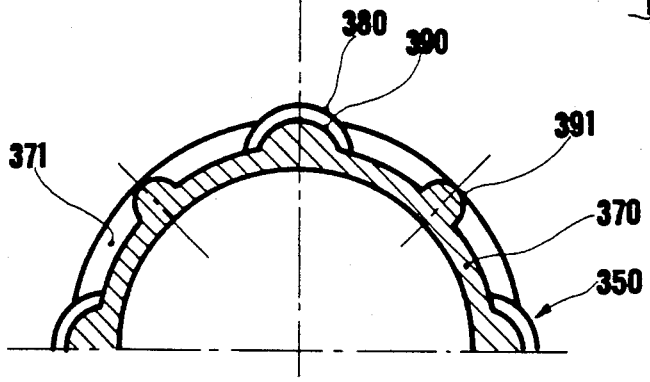
FIG.7

DISPENSER FOR PASTY PRODUCT

The invention relates to dispensers for pasty products and more particularly to those using on the one hand a compression and suction system controlled by the squeezing of their flexible plastics material head and on the other hand a sliding piston. The term pasty product in the present context covers any product having a pasty consistency, which can be distributed by means of such a device and which can be called a paste, gel or thick cream.

KNOWN PRIOR ART

EP-A No. 0048421 (U.S. Pat. No. 4,394,939) describes a dispenser for pasty products, whereof the other upper part of its body carries a valve for the suction of the pasty product from the storage chamber between its sliding piston and said upper part towards the pumping or compression chamber, said valve having a seat with lateral passage windows and an annular part for sealing said windows, said part being connected by at least three flexible arms to a hub, which is itself fixed to a spindle or to a central pin of the underlying seat. The dome of the head fixed by catching or ratching to the body is flexible and crushable, so that by squeezing or crushing and then release, it is possible to expel the pasty product and to suck the same from the storage chamber towards the pumping or compression chamber. The valve for expelling the product towards the pipe and the distribution orifice has as its seat the end of the tube surmounting the dome and comprises a flap fixed to the interior of the actuator. The assembly of the suction, compression and expulsion means consequently involves five parts, or three parts besides the distributor body and the actuator. The annular part for sealing passage windows for the product from the storage chamber to the pumping or compression chamber is relatively fragile.

DEFINITION OF THE PROBLEM

In the known art, assembly is complicated and difficult and certain parts are fragile. The present Applicant has attempted to obtain for mass production purposes, an assembly of suction, compression and expulsion parts for the product of a more robust nature and which can be more easily assembled.

DESCRIPTION OF THE INVENTION

The present invention relates to a dispenser for pasty products which, as is known from EP-A No. 0048421, comprises:

(a) a body comprising a tubular member, a piston sliding within said tubular member and a top carrying a valve for sucking the pasty product into the compression chamber and, on its periphery, means for fixing the distributing head;

(b) a dispensing head fixed to the body and having: an actuator provided with a bearing web and a distribution pipe, a valve for expelling the product into said distribution pipe, located between the compression chamber and said pipe, a deformable web defining with the top of the body and the expulsion valve a compression chamber.

According to the invention, the dispenser is characterized in that:

(a1) the top of the body has a central orifice surrounded by an annular bearing surface constituting the seat for the suction valve and the flap of said valve is constituted by a sealing web, whose annular edge is tightly applied to said annular surface in the valve closure position and an underlying cylindrical portion engaged in said central orifice and provided in its lower part with retaining reliefs;

(b1) the actuator comprises on the one hand a fixed part having an external skirt carrying in its lower part means for fixing to the top of the distributor body and on the other hand an inclinable central part connected to the fixed part and having a bearing web, as well as a distribution pipe issuing into a longitudinal duct carried by the bottom of said bearing web and which tightly fits the upper tube of a deformable cap forming with said bearing web and with said top of the distributor body the compression chamber, the bottom surface of said web at the base of said duct being planar or having a limited curvature; (b2) the deformable web defining the compression chamber is comprised in said deformable cap, which is in one piece and comprises from bottom to top a means for the tight fixing to the top of the distributor body, then the deformable web, then the upper tube surmounted by a flexible upper lip forming with said surface of the base of said duct the valve for expelling the product into the distribution chamber.

Thus, the means for passing the pasty product from the storage chamber to the distribution duct are entirely novel.

As the deformable cap is a separate member, its constitutive material can be specifically chosen, at the same time as its geometry and thickness variations, so as to obtain a good flexibility and a good elasticity of its deformable web, as well as its upper lip forming the expulsion valve, in association with the nature of the distributed pasty product. The fixed outer skirt of the actuator locks the bottom of said deformable cap and protects its periphery whilst the oriented support on the inclinable central part of the actuator produces a lever effect and in particularly reproducible manner leads to the squeezing or crushing of the compression chamber and the expulsion of the pasty product by the base of the duct and the distribution pipe of said inclinable part. The suction valve, whose opening, once said support has been released, enables the pasty product to rise in the compression chamber, is integral with the top of the distributor body. Assembling is then very easy. The deformable cap is fixed in the actuator, so as to bring about the tight fixing thereof to the inclinable central part of the actuator. The assembly is then fixed to the top of the distributor body, e.g. by ratching, or by any other fixing means, such as screwing, bonding or welding. To facilitate the fixing of the deformable cap in the actuator, the cap preferably comprises between its fixing means to the distributor body and its deformable web, a lower tube fitting with limited clearance, preferably less than 0.6 mm of the diameter, in the outer skirt of the actuator. Typically, the upper tube of the deformable cap and the longitudinal duct of the actuator carry complimentary tight fixing means cooperating during the fitting of the tube and duct, e.g. a circular rib outside the tube and a circular groove inside the duct.

The means for tightly fixing the deformable cap to the top of the distributor body is advantageously a circular lower edge outside said cap, the top of the dispenser body having a peripheral bearing surface for said edge and the outer skirt of the actuator has an internal bearing surface which, on fitting, secures said circular lower edge of the cap to said peripheral bearing surface.

Particular attention must be paid to the suction valve, because its flap is rendered integral with the top of the dispenser body by forcing its retaining reliefs through the orifice, which is central or roughly central with respect to said top. As these reliefs must be ratchable, whilst still performing their retaining function consisting of regulating and limiting the opening travel of the flap, without there being any risk of jamming of said reliefs in the orifice, they are preferably transverse bosses having a circumscribed cylinder diameter exceeding by 1 to 2 mm the diameter of the orifice of the top.

In order to obtain both a good guidance of the suction valve through the orifice of the top of the distributor body and an easy flow of the pasty product through the annular opening space of the valve formed by the flap and the periphery of the orifice, it is preferable to also have for the cylindrical portion of the flap located outside the retaining reliefs, both intermediate cylindrical surface portions with a relatively small diameter and longitudinal bosses, i.e. rounded relief cylindrical portions having a larger overall diameter, but smaller by at least 0.6 mm than the diameter of the orifice, said longitudinal bosses then serving to guide the flap through the orifice. The external diameter of the annular edge of the sealing web of the suction valve is chosen in such a way that sealing is obtained in the entire closure position of said valve, bearing in mind the clearance of the flap in the orifice.

Preferably, the transverse retaining bosses have upper and lower inclined or rounded surfaces, so as to obtain a gentle stopping of the flap and facilitating its initial ratching through the orifice of the top of the distributor body and the overall diameter on the longitudinal guidance ribs or bosses is less by 1 to 2 mm than the diameter of said orifice, said condition providing a good compromise between the guidance requirement and that of the passage of a flow of pasty product between the flap and the orifice. The flap is advantageously obtained by integral moulding with the top of the distributor body.

In this case, the lateral surface of the central orifice of said top and the bottom of the outer surface of the cylindrical portion of the flap in each case have circumferential fracture zones of heights 0.1 to 0.3 mm corresponding by fitting.

Finally, the sealing web of the flap can serve as a regulating means for the squeezing of the compression chamber, whereby said squeezing can increase when the central part of the web is hollowed out within the cylindrical portion of the flap.

The actuator preferably has an outer skirt which is notched at the front and rear, the front designating the orientation of the pasty product distribution orifice and an inclinable central part connected to said skirt by a deformable tab extends from the bottom of the distribution pipe up to the bottom of the notch in the skirt. The notches facilitate the operation of the actuator and fix the orientation of the squeezing of the compression chamber. This actuator can be made inviolable by at least one breakable bridge positioned transversely with respect to the plane of symmetry of the actuator and connecting the top of its inclinable central part to the top of its outer skirt.

The actuator is produced by moulding, typically of PP (polypropylene) or HD-PE (high density polyethylene), as is the cover.

The actuator is typically obtained in one-piece form by injection moulding, its deformable tab then constituting the bridge between its two parts. The deformable cap according to the invention is also moulded and namely from one of the materials of the group formed by thermoplastic polymers, silicone resins, natural rubber and artificial rubbers. Deformable caps of particularly high quality have thus been produced from a polyester-ether.

The invention also relates to a process for the production of the dispenser body, whose top carries an orifice, as well as a suction flap or valve constituted by a sealing web applied to the periphery of the orifice and an underlying cylindrical portion engaged in said orifice and carrying in its lower part retaining reliefs, in which:

(A) the retaining reliefs are constituted by transverse bosses leaving between them cylindrical surface portions, the diameter of the cylinder circumscribed with said bosses exceeding by 1 to 2 mm the diameter of the central orifice;

(B) onto the tubular member of the dispenser which is made from a plastic or metal-plastic material, is injected a plastic material part reproducing the top with its orifice, as well as the flap, the bottom of the cylindrical portion of the latter being connected to the lateral surface of the orifice of the top by a breakable ring with a thickness of 0.1 to 0.3 mm;

(C) after removal from the mould, a bearing pressure is applied to the sealing web of the flap, so as to break the breakable ring and force the transverse bosses through the orifice.

The description of an embodiment of the dispenser according to the invention, with two constructional variants of its suction valve or flap, will provide a better understanding of the structure and operation.

EXAMPLES

FIGS. 6 and 7 show a moulding variant and a structural variant of the valve, according to the same views as FIGS. 4 and 5.

Figure 1:
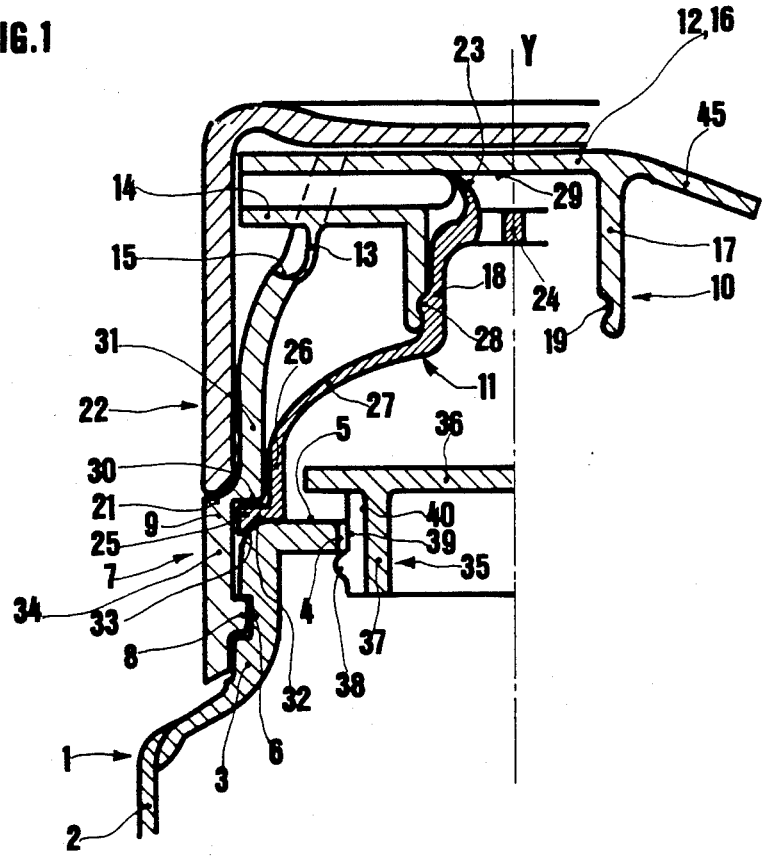
FIG. 1 shows a first dispenser, according to the invention, the head being fixed to the top of the dispenser body, the central inclinable part of the actuator being shown in axial section and the other elements in longitudinal axial half-section.

For clarity of the description, the bosses of the cylindrical portion of each suction valve are shown in non-hatched form in the axial sections.

The body of the dispenser, whereof only the top is shown (FIG. 1) is made from a plastics material and has a tubular member incorporating a cylindrical skirt 2 of external diameter 35 mm and thickness 1 mm made from HD-PE. On said skirt is overfilled a HD-PE top 3, which has a central orifice 4 with a diameter of 22 mm with, on the periphery of the latter, a planar annular surface 5 with an external diameter 30 mm. On the periphery of top 3 there is a circular groove 6 permitting the fixing of the distribution head 7 by ratching or catching of a rib 8 of the lower part of the outer skirt 9 with its actuator 10.

The dispensing head 7 is in two parts, namely the deformable cap 11 and the actuator 10, which itself comprises the fixed outer skirt 9 and the inclinable central part 10 connected to skirt 9 by a deformable tab 13, which attaches the bottom of its distribution pipe 14 to the base of the front notch 15 of said skirt 9. The inclinable central part 12 of actuator 10 comprises a bearing web 16, on which is pressed a finger to obtain a distribution of a little pasty or creamy product, whilst below said bearing web 16 is provided a duct 17, from which issues the distribution pipe 14. Duct 17 has a position and geometry such that fitting takes place between the upper tube 18 and the deformable cap 11 and has a groove 19 permitting the fixing of said tube 18 by ratching. The outer skirt 9 of actuator 10 is fixed to the top 3 of distributor body 1 by the ratching of its rib 8. It has the front notch 15, whose width is 11 mm exceeding that of the 8 mm of the rectangular distribution pipe. It also has a larger rear notch 20 (FIG. 2) of width 20 mm and height 17 mm permitting easy engagement of a finger on the bearing web 16. Apart from the ease of manipulation, the two notches 15, 20 lead to roughly constant bearing and bearing orientation, leasing to a jerk-free crushing of the compression chamber and a regular product distribution. The outer skirt 9 also has an outer bearing edge 21 of cover 22. The actuator is made from integral polypropylene with thicknesses generally between 1 and 1.2 mm, with the exception of the thinner (0.8 mm) deformable tab 13.

The deformable cap 11 is of moulded polyester-ether with thicknesses ranging from 1 mm for the upper tube 18 to approximately 0.2 mm for the end of the upper flexible lip 23. The transverse crosspiece 24 carried by the interior of the upper tube 18 corresponds to moulding feed and does not impede the outflow of product. Passing from bottom to top, the cap 11 successively comprises a circular lower edge or base 25, a lower tube 26, a deformable, dome-shaped web 27, the upper tube 18, which carries a fine circular external rib 28 of height 0.5 mm and which is fixed in the ratching groove 19 of duct 17 of actuator 10, and finally, surmounting said tube 18, the upper flexible lip 23. The end of the upper lip 23 has a diameter of 12 mm and, on fitting, is placed against the planar surface 29 of the bottom of the bearing web 16 at the base of the duct 17 of actuator 10 having an internal diameter 14 mm, when said duct 17 fits with a limited clearance tube 18 in groove 19 of duct 17. In the position of FIG. 1, i.e. at the end of suction or at rest, lip 23 tightly bears by elastic return against surface 29.

Thus, installation comprises fixing the upper tube 18 of the deformable cap 11 in actuator 10. The lower edge 25 has a horizontal top surface, which faces an internal bearing surface 30 of outer skirt 9 and, in addition, the lower tube 26 is then fitted with a limited clearance within a straight portion 31 of skirt 9. Thus, the deformable cap 11 is connected both to the inclinable central part 12 of the actuator and is joined at its base with the outer skirt 9. The distribution head 7 is thus formed by the assembly of these two parts 10 and 11 and is fixed to the top 3 of the distributor body 1 by the ratching of rib 8 of skirt 9 in groove 6 of top 3. The bottom surface 32 of the lower edge 25 of deformable cap 11 is horizontal on its inner part and inclined, i.e. truncated cone-shaped, on its outer part, whereby said two parts of surface 32 respectively bear on the peripherary of the planar annular surface 5 of top 3 and on a peripheral chamfer 33 of said top 3. The outer skirt 9 brings about by its straight portion 34 a radial securing of edge 25 and by its bearing surface 30 an axial securing of said same edge 25, the adopted arrangement being particularly tight.

FIG. 1 also shows the suction flap 35 constituted by a planar sealing web 36 of thickness 0.8 mm and diameter 26 mm and an underlying cylindrical portion 37 provided in its lower part with rounded transverse bosses 38 of circumscribed cylinder diameter 23.5 mm, said retaining bosses 38 and web 36 retaining flap 35 in orifice 4 and also having longitudinal rounded reliefs 39, the overall diameter on said reliefs 39 being 20.5 mm, as well as intermediate cylindrical surface portions 40 of diameter 19 mm. The axial travel of flap 35, limited by the retaining bosses 18, is 3 mm and with the diameter of the central orifice being 20 mm, the guidance reliefs 39 maintain valve 35 in direction, whilst ensuring its closure bearing on the annular surface 5 at the time of compression.

Figure 2:
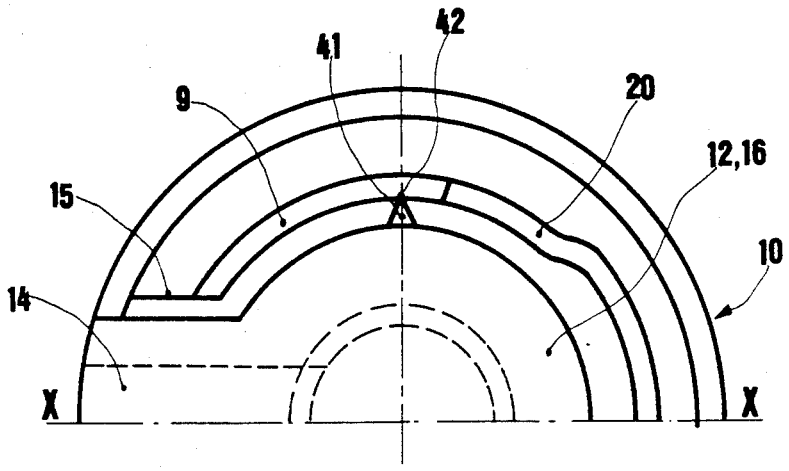
FIG. 2 shows the head of the same dispenser rendered inviolable in a half-view from above.

FIG. 2 shows actuator 10 in a half-view from above, which has been made inviolable by two breakable bridges 41 positioned transversely and typically roughly 90° from the plane of symmetry (XX) of actuator 10 passing through the axis of the distribution pipe 14. These bridges 41 connect the top of the inclinable central part 12 of actuator 10 to the top of its skirt 9. At the first bearing point, which inclines the central part 12 about the fixed end of the deformable tab 13, bridges 41 are overstretched and break. These bridges preferably have a tapered end 42 on the side of skirt 9, so that their broken part remains attached to the mobile part 12 of the actuator and does not prejudice subsequent movements.

Figure 3:
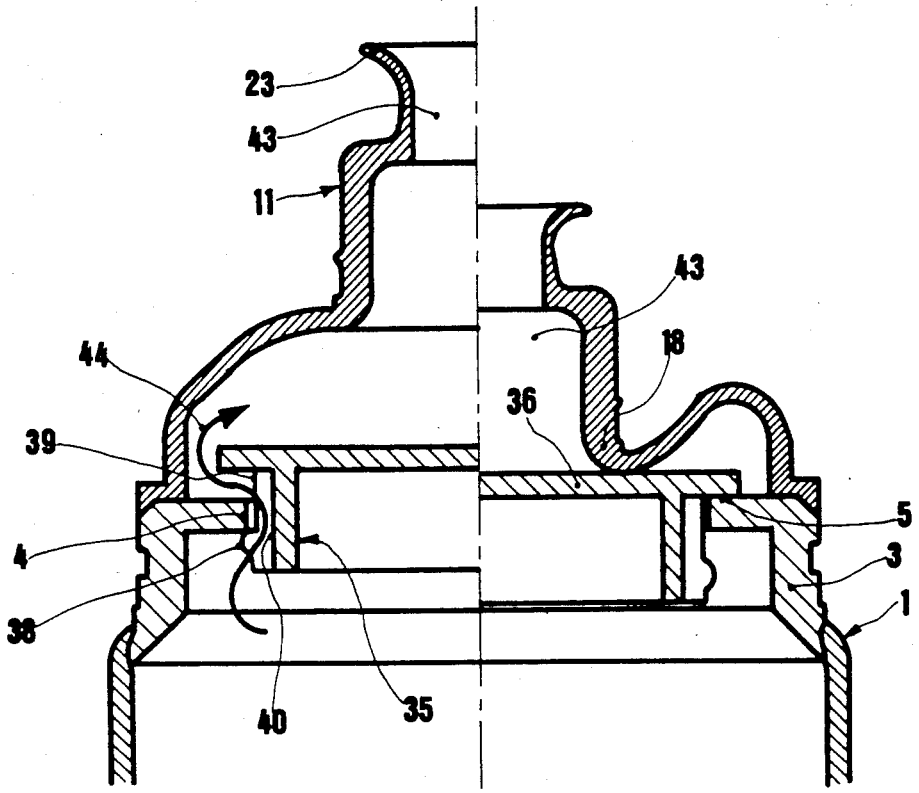
FIG. 3 shows the deformable cap and the top of the body of the same dispenser in two axial half-sections, during the suction phase and during the expulsion phase of the pasty product.

In the left-hand half of FIG. 3, which reproduces part of FIG. 1, the suction phase is shown, the deformable cap 11 having roughly resumed its initial position, the bearing action on the actuator having been released and the upper lip 23 of cap 11 has elastically opened out against the planar surface 29 of bearing web 16 (FIG. 1), whilst closing the top of the compression chamber 43. The wavy arrow 44 indicates the path of the pasty product through the annular clearance between the suction valve 35, which is raised by the pressure reduction effect, and the edge of the orifice 4 of thickness or height 1.2 mm. The product passes round the retaining bosses 38 and travels along the intermediate cylindrical surface portions 40, which have a clearance maximum compared with orifice 4 and to a lesser extent along the longitudinal guidance reliefs 39. The importance of the guidance and clearance conditions for obtaining a good operation of the valve and particularly with respect to the pasty product flow is readily apparent.

The right-hand part of FIG. 3 shows the cap 11 at the end of compression, the bottom of the relatively rigid upper tube 18 abutting against the sealing web 36 of the suction valve 35, which is applied by pressure to the planar annular surface 5 of the top 3 of the body of distributor 1. The compression of chamber 43 produces the expulsion of the pasty product between the upper lip 23 of cap 11 and the base 29 of duct 17 (FIG. 1), said upper lip 23 also being bent by the passage of said pasty flow directed towards the distribution duct 14. It is interesting to note in connection with the compression phase (FIG. 1), that the bearing action on the actuator is effected on the rear portion 45 of bearing web 16, to the rear of the vertical axis of symmetry Y of cap 11, the deformable tab 13 of actuator 10 serving as a flexible articulation, which gives a lever effect for the elastic compression of cap 11, thus aiding a regular compression and expulsion of the pasty product.

Figures 4, 5:
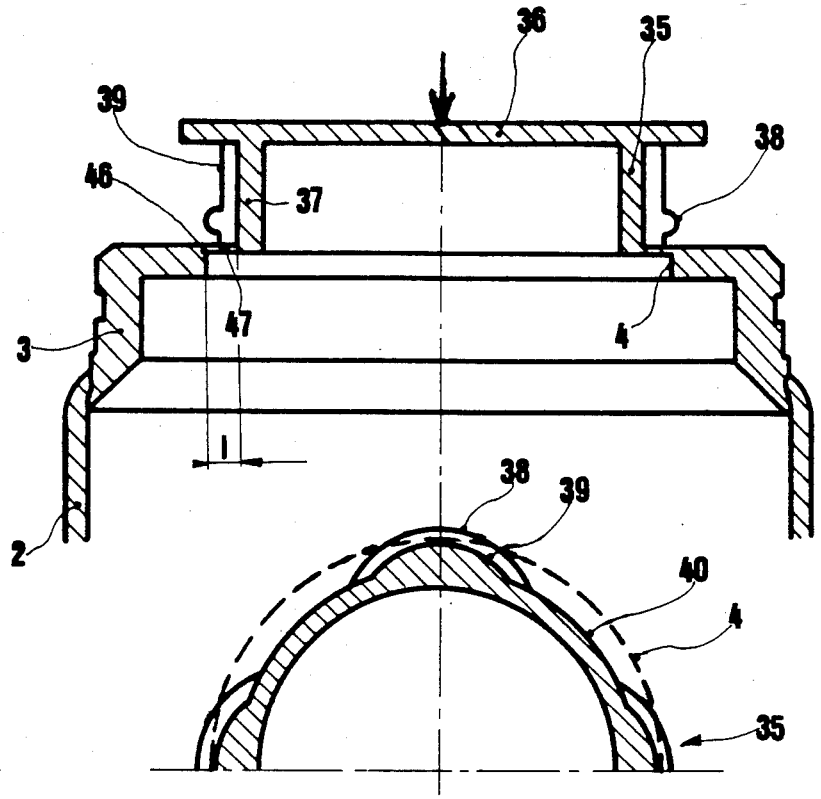
FIG. 4 shows the top of the body of the same dispenser as obtained from the moulding process and in axial section.
FIG. 5 shows the valve, viewed from above in half-section.

FIG. 4 shows the position of the same valve 35 moulded at the same time as the rest of the top 3 of the distributor body 1 on the cylindrical skirt 2 of thickness 1 mm of the tubular member. The bottom of the cylindrical portion 37 of valve 35 is connected to the top 46 of the lateral surface of orifice 4 by a plastics material ring 47 of thickness approximately 0.15 mm and width 1 0.7 to 1.5 mm, the injection point (arrow) corresponding to the centre of the sealing web 36. The downward pressure of valve 35 leads to the passage of the retaining bosses 38 below orifice 4.

FIG. 5, which shows flap 35 in plan view, completes its geometrical description started in connection with FIG. 1. Its transverse retaining bosses 38 are four in number and are spaced by 90°. They have an external contour and a circular cross-sectional contour with an individual width of 8 mm and a thickness of 1 mm. They are in the form of protuberances of the four longitudinal guidance reliefs 39, each having a circular cross-sectional contour and a width of 6 mm, whilst extending over a height of 5 mm from the bottom of valve 35 up to its sealing web 36. The actual guidance portion thereof is that located between the retaining bosses 38 and web 36 and has a height of 3 mm. The broken line path of the contour of diameter 22 mm of orifice 4 shows the widening of the passage gap for the pasty product facing the intermediate cylindrical surface portions 40 of diameter 19 mm.

FIG. 6 shows the valve 350, whereof the sealing web 360, having the same periphery 361 as web 36 of valve 35, is shaped like a dish. In such a way as to permit a greater compression of cap 11, the central part 362 of said web 360 is lowered by 3 mm within cylindrical portion 370 and the sealing function of web 360 is then completed by the upper part 362 of cylindrical portion 370. The lower end of said cylindrical portion 370 has an outer ring 371 of thickness 0.7 mm and diameter 20.5 mm. The plastics material ring 470 of thickness 0.15 mm connecting the top 46 of orifice 4 to the top of said outer ring 371 has a roughly constant width of 0.7 to 0.8 mm. The breaking thereof is particularly easy.

FIG. 7 is a plan view of the same valve 350. It can be seen that there are four retaining bosses 380, spaced by 90°, like those of valve 35 and carried by four longitudinal guidance bosses 390 of width 4 mm. There are also four intermediate longitudinal bosses 391, corresponding to the same overall diameter of 20.5 mm as that of bosses 390, having a substantially semicircular cross-section and a radius of 1 mm. These 8 guidance bosses 390 and 391 carried by the cylindrical portion 370 and regularly distributed over its circumference extend from the outer ring 371 up to the peripherary 361 of the sealing web 360. Their number and their relatively large curvatures lead to a good operating regularity of valve 350.

In general terms, it is desirable to have for a valve according to the invention typically moving within a 15 to 30 mm diameter orifice, 3 to 6 retaining bosses and 4 to 12 longitudinal guidance bosses. The guidance bosses can be omitted, but the distributor operating results are then less satisfactory.

APPLICATIONS

The dispensing head according to the invention can be fitted onto various dispenser bodies, having a cylindrical skirt and a widened base, usually in one-piece form, and in particular to dispenser bodies made from HD-PE, polypropylene, thermoplastic polymer, glass or metal, e.g. aluminium.

The attachment of the dispensing head to the top of the dispenser body can take place by a mechanical means such as crimping, ratching, screwing or bonding, or even by welding in the case of compatible plastics materials.

The dispensing head according to the invention fitted to an appropriate dispenser body is typically used for the packaging and distribution of hygienic and cosmetic products, in the form of pastes or gels and in particular toothpastes, as well as for food products in the form of pastes or thick creams, e.g. condiments and similar products.

We claim:

1. Dispenser for pasty products comprising:

a body (1) incorporating a tubular member adapted to receive a piston sliding therein, and a top (3) on said tubular member;

a dispensing head (7), means (6) on said top (3) for fixing the dispensing head to the body (1), said dispensing head having an actuator (10) incorporating a bearing web (16) and a distribution pipe (14), a deformable cap (11) on said top defining a compression chamber (43), a suction valve (35, 5) (350, 5) between said top and said compression chamber for suction of pasty product into said compression chamber, and an expulsion valve (23 and 29) defined between the compression chamber (43) and said distribution pipe (14) for expelling the product into said distribution pipe (14);

the top (3) of body (1) having a central orifice (4) surrounded by an annular bearing surface (5) comprising the seat of the suction valve (35, 5) (350, 5), said suction valve including a flap (35, 350) comprising a sealing web (36, 360) with an annular edge (361) seated on said annular surface (5) when the suction valve (35, 5) (350, 5) is in the closed position, and an underlying cylindrical portion (37, 370) engaged in said central orifice (4) and provided in its lower part with retaining reliefs (38, 380);

said actuator (10) comprising a fixed part having an outer skirt (9) carrying on its lower part means (8) for fixing to the top (3) and an inclinable central part (12) connected to said fixed part (9) and having the bearing web (16), as well as the distribution pipe (14), issuing into a longitudinal duct (17) carried by the bearing web (16) and which tightly fits an upper tube (18) formed by the deformable cap (11) to define the compression chamber (45) between said bearing web (16) and said top (3), said bearing web (16) having a bottom surface (29) on the base of said duct (17), the bottom surface being planar or having limited curvature;

said deformable cap (11), which is in one piece, running from bottom to top comprising means (25) for the tight fixing to the top (3), then a deformable web (27), followed by the upper tube (18) surmounted by a flexible upper lip (23) forming with said bottom surface (29) the expulsion valve (23,

29) for expelling the product into the distribution pipe (14).

2. Dispenser according to claim 1, characterized in that the upper tube (18) of the deformable cap (11) and the longitudinal duct (17) of the inclinable central part of the actuator (10) fitting said tube (18) carry complimentary means (19, 28) for the tight fixing of said tube (18) in said duct (17) constituted by a circular rib (28) of tube (18) and a circular groove (19) in the interior of said duct (17).

3. Dispenser according to either of the claims 1 or 2, characterized in that the means for the tight fixing of the deformable tubular cap (11) to the distributor body (1) is a circular lower edge (25), the top (3) having a peripheral bearing surface (5, 33) for said edge (25) and the outer skirt (9) of actuator (10) has an inner bearing surface (30) which, on fitting, secures said lower circular edge (25) on the peripheral bearing surface (5, 33) of top (3) of dispenser body (1).

4. Dispenser according to claim 1, characterized in that the retaining reliefs (38, 380) of cylindrical portion (37, 370) of flap (35, 350) of the suction valve are transverse bosses, the diameter of the cylinder circumscribed with said bosses (38, 380) exceeding by 1 to 2 mm the diameter of the central orifice (4) of top (3) of dispenser body (1).

5. Dispenser according to claim 4, characterized in that the cylindrical portion (37, 370) of flap (35, 350) of the suction valve carries longitudinal guidance bushes (39, 390, 391) leaving between them intermediate cylindrical surface portions (40), the overall diameter of said bosses being smaller by at least 0.6 mm than the diameter of central orifice (4).

6. Dispenser according to claim 5, characterized in that the retaining bosses (38, 380) have upper and lower inclined or rounded surfaces and in that the overall diameter on said longitudinal guidance bosses is smaller by 1 to 2 mm than the diameter of the central orifice (4).

7. Dispenser according to claim 6, characterized in that the lateral surface of the central orifice (4) and the bottom of the outer surface of the cylindrical portion (37, 370) of suction valve (35, 350) carry fracture zones of heights 0.1 to 0.3 mm, which correspond by fitting.

8. Dispenser according to any one of the claims 4 to 7, characterized in that the sealing web (360) of suction valve (350) has a hollowed out portion (362) within its underlying cylindrical part (370).

9. Dispenser according to claim 8, characterized in that the outer skirt (9) of actuator (10) carries a front notch (15) and a rear notch (20) and in that the inclinable central part (12) of actuator (10) is connected to the outer skirt (9) by a deformable tab (13) extending from the bottom of the distribution pipe (14) up to the bottom of the front notch (15) of skirt (9).

10. Dispenser according to claim 9, characterized in that its actuator (10) has at least one breakable bridge (41) positioned transversely with respect to the plane of symmetry (XX) of actuator (10) and connecting the top (16) of its inclinable central part (12) to the top of its outer skirt (9).

11. Dispenser according to claim 10, characterized in that its deformable cap (11) is made from one of the materials in the group formed by thermoplastic polymers, silicone resins, natural rubber and synthetic rubbers.

12. Dispenser according to claim 11, characterized in that its deformable cap (11) is made from polyester-ether.

13. Dispenser according to claim 1, characterized in that the outer skirt (9) of actuator (10) carries a front notch (15) and a rear notch (20) and in that the inclinable central part (12) of actuator (10) is connected to the outer skirt (9) by a deformable tab (13) extending from the bottom of the distribution pipe (14) up to the bottom of the front notch (15) of skirt (9).

14. Dispenser according to claim 1, characterized in that its actuator (10) has at least one breakable bridge (41) positioned transversely with respect to the plane of symmetry (XX) of actuator (10) and connecting to the top (16) of its inclinable central part (12) to the top of its outer skirt (9).

15. Dispenser according to claim 1, characterized in that its deformable cap (11) is made from one of the materials in the group formed by the thermoplastic polymers, silicone resins, natural rubber and synthetic rubbers.

16. Dispenser according to claim 1 wherein, prior to use, the cylindrical portion (37, 370) of the suction valve is connected to a laterally aligned surface of the central orifice (4) of the top (3) by a breakable ring having a thickness of 0.1 mm to 0.3 mm.

* * * * *